United States Patent [19]

Marsland et al.

[11] Patent Number: 4,620,819

[45] Date of Patent: Nov. 4, 1986

[54] SUBMARINE WORKING EQUIPMENT

[75] Inventors: George E. Marsland; Heinz Marschner, both of Kressbronn; Klaüs Wiemer, Stuttgart; Thomas Weyer, Oberteuringen; Hubert Knoblauch, Hagnau, all of Fed. Rep. of Germany

[73] Assignee: ZF-Herion Systemtechnik GmbH, Friedrichshafen, Fed. Rep. of Germany

[21] Appl. No.: 722,757

[22] Filed: Apr. 15, 1985

Related U.S. Application Data

[63] Continuation of Ser. No. 460,606, Jan. 24, 1983, abandoned.

[30] Foreign Application Priority Data

Jan. 23, 1982 [DE] Fed. Rep. of Germany ..... 3202106

[51] Int. Cl.[4] ..... B63C 11/34

[52] U.S. Cl. ..... 405/185; 405/190; 114/312

[58] Field of Search ..... 405/158, 188, 190, 191, 405/185; 114/312, 313, 315

[56] References Cited

U.S. PATENT DOCUMENTS

| | | | |
|---|---|---|---|
| 3,418,818 | 12/1968 | Vincent et al. | 405/190 |
| 3,550,386 | 12/1970 | Ballinger | 405/191 |
| 3,626,703 | 12/1971 | Richburg | 405/191 |
| 4,010,619 | 3/1977 | Hightower et al. | 405/191 |
| 4,030,434 | 6/1977 | Pedlar et al. | 405/191 X |

OTHER PUBLICATIONS

"Meerestechnik", 6/1981, S. 176 u. 177.

*Primary Examiner*—David H. Corbin
*Attorney, Agent, or Firm*—Hayes, Davis & Soloway

[57] ABSTRACT

The submarine working equipment illustrated which may be a diver's auxiliary equipment includes a hollow body that is specially reinforced against bending moments and pressure forces acting upon it by means of structure defining flow channels, for driving elements, that angularly penetrate it and by means of pressure chambers supported in the body which are adapted to multiple uses. The equipment is held and supplied with power by a connecting and supply cable. A main grab on the forward end of the body is adjustable to facilitate clamping on a wide range of diameters the clamping of the equipment on pipes, wracks, etc. so firmly that the equipment itself or working arms mounted thereon (tool arms, auxiliary grabs, platforms etc.) are capable of taking substantial working loads despite the small dimensions of the equipment. Control instruments and the driving elements permit the equipment to be used in a particularly efficient and safe manner both as a vehicle for mobile equipment and as tool machine or energy base for auxiliary machines in submarine operations with or without a diver's presence. The equipment can be quickly and reliably adapted to changing working conditions by easy replacement of modularly interchangeable supplementary equipment.

9 Claims, 10 Drawing Figures

SUBMARINE WORKING EQUIPMENT

This is a continuation of co-pending application Ser. No. 460,606, filed on Jan. 24, 1983, now abandoned.

This invention relates to mobile submarine working equipment for the operation of gripping and processing tools, operating and inspection apparatus, and accessory energy and signal control instruments, etc. such as needed, for example, to provide, in deep water (150 meters, for instance) an effective work producing combination capable of safe operation on wrecks, derricks, pipelines, etc. with and without diver accompaniment. More particularly the invention provides a modification of a submarine working equipment with an arrangement of the main grab which permits greater applicability and service performance and which reduces the danger of interruptions and accidents.

Submarine apparatus oriented to a similar problem but exclusively confined to diver accompaniment are known already, for example, from German Utility Model 78 34 318. The construction thereof is primarily characterized by an equipment carrier of "frameline" build and a working plate that carries the drive and control means. To obtain the almost weightless condition usually required in use, lifting members are introduced in the frame as needed. A pivotable horizontal and a vertical propeller serves as a drive element. Swivel arms for gripping tongs or tools are usually disposed on a forward end of the frame.

In view of the considerable expense and high risk of the submarine operations, equipment used must contribute to reducing or simplifying the time taken for transportation of tools and accessories from the supply ship to the place of use and to ensuring that neither the divers nor the working equipment or processing parts (such as pipelines, platform supports, etc.) are exposed to the dangers of collision. Therefore, the fittings of such a submarine working equipment must be provided in as universal a manner as possible while making allowances for the work aggravating conditions or risks. In this respect the known prior art still needs improvement.

It is an object of the present invention to provide a submarine working equipment having an increased range of use and efficiency with reduced risk in operation of accidents.

According to the invention there is provided a submarine working equipment comprising an equipment carrier to which are mounted operating implements, light sources, orientation instruments and control instruments, and driving elements, said working equipment being held captive and supplied with power by a connecting and supply cable wherein said equipment carrier is a self-supporting hollow body, penetrated by flow channels angularly disposed in relation to each other, in which said driving elements are situated.

By designing the equipment carrier as a self-supporting hollow body that is penetrated by flow channels, the defining structure of which provides reinforcement of the body, where the drive elements (such as the propellers) are, susceptibility to shock (for instance, compared to frame constructions) can be reduced and bending resistance (even when light metal is used) be improved. In a hollow body the closed outer surfaces (except for the openings of the flow channels) also offer less occasion for unwanted changes of direction, a lower magnitude of the reaction forces, reduced flow effects, and lower pitching moments so that the drive elements for trimming the working equipment need to be operated less often or for shorter periods of time.

Whilst the frameline-structure of said prior art shows a lot of separately fixed chambers and blower tunnels etc. heterogenously arranged in an open fragile structure causing irregular flow resistance, the hollow body of the invention permits the direct integration of various chambers and channels and thus a very compact shock resistant structure forming a homogene body with streamline contours.

The chambers built into the hollow body itself may serve (under variable pressures) not only to reinforce the follow body but also for various other purposes. Preferably, on the upper side of the hollow body is secured a rotatable pad having a foldable platform pivotably mounted thereon, the platform being moveable by means of power from the supply cable to the equipment. The upper side of the hollow body may have secure to it a swinging bracket with arms which are pivotable mounted in the side walls of the hollow body and in the center of which is located a cable inlet chamber for connecting a supply cable. This swinging bracket may carry a cable length control in a cable inlet chamber adjacent thereto. This can be used for weight trimming the equipment.

The hollow body may house lifting members which, when driving elements are disconnected, produce a slightly diminished speed of the equipment. The invention may include a local control arrangement housed in a control desk that can be introduced from the outside into said hollow body and which can be transitorily removed therefrom from remote control, the local control may be operated by way of a control cable when spaced from the equipment.

The stucture of the hollow body may comprise a plurality of dividers defining pressure chambers near the main grab in which orientation instruments, control instruments and auxiliary drives may be accommodated. Below the horizontal flow channel there may be provided tool boxes for processing emplements and other working utensils. These boxes may be adapted to be opened from the outside of the equipment and may also provide for equipment connections for the processing implements.

Besides hydraulic oil storage tanks in which hydraulic equipment (such as pumps and valves etc.) is submerged directly and at the same time pressure protected by the hollow body (respectively the chambers and channels penetrating and reinforcing the hollow body) there are other chambers for tools, cables etc. and for buoyancy material. The latter provides at the same time weight-compensation and prevention of a collapse of the hollow body under the external pressure in great depths. Thanks to this arrangement it is possible too to integrate a heat exchanger into the oil tank where warm water is produced for the survival systems of the divers which are alimented by the inventional working equipment. Except the chambers for tools etc. the access to the chambers is limited to times above the water. Then however the access is quickly and simply possible without hindrance by a tubular frame structure with its open installation system as shown by prior art.

Even the chambers which are open to environment and serve as blower channels for certain propellers have tubular hulls, being part of the hollow body itself and reinforcing it too.

The arrangement of the flow channels in the hollow body is specially advantageous for trimming because their horizontal and vertical effective lines intersect each other in or close to the mass center of the completely outfitted working equipment. This is easier to obtain in the construction of the present invention than in the open frame constructions with their alternating utilization of interior space.

The smooth outer surfaces of the hollow body in addition give less occasion for loose particles and objects that pass by to be trapped in or by the equipment, by comparison with a frame construction, and less chance of contact with a propeller.

Pressure chambers firmly mounted within the hollow body itself, provide, at the same time, an additional reinforcement and serve as lifting elements. Easy access is possible to the interior of the pressure chambers (unlike in the frame construction) by covers, the flanges of which provide a buckling resistance on the outer surfaces of the hollow body. This permits easy storage or housing of parts. Pre-assembled components can easily be inserted like drawers in the pressure chambers and protected from shock.

Preferably the support point of the main grab lies very close to the mass center and the foreward wall of the hollow body is further reinforced by the bearing assembly of the main grab attached to a recess.

The maximum pitching moment resulting with a fully extended and laden grab is preferably counteracted by two vertically oriented drive elements situated ahead the horizontal tilt axis.

The pressure chambers may be firmly integrated in the hollow body, can be used for different outfitting elements and can provide additional lifting forces in the immediate proximity of the mass center.

Some of the pressure chambers may be used, in addition to being lifting members, as storing spaces (for instance, as a hydraulic oil tank or for heat-exchange elements, for example, for producing hot water) and may be also capable of carrying a load to act as a counterweight against torque from said gripper.

The hollow body is preferably smoothly shaped with an outer contour that reduces or stabilizes the flow effects and reduces also the danger of snagging, for instance, on building parts, cables and hoses.

The contour is preferably yieldable to absorb shocks or blows in a manner such that, for example, in a collision with wreck parts or structures while maneuvering, functionally indispensable parts of the working equipment are not immediately endangered, and the danger of crushing of divers is lessened.

The mounting points for processing tools, etc. are preferably integrated in the body contour to ensure against loss, and are arranged so that no parts can fall in the flow channels. The lids of the tool boxes can be shaped as footboards for an accompanying diver.

The energy supply connections for the tools may be incorporated in the interior of the body in a manner such that no ramming dangers threaten and hose couplings, etc. The preferred underwater-change couplings here are more secure against soiling.

The homogenous arrangement of the various elements in one common hollow body facilitates an external streamline cladding of the vehicle. This is advantageous for two reasons. Firstly the vehicle is required to work in situations where current flow can be considerable and this should have as little effect as possible during manuevering. The second reason is that the vehicle has to pass into underwater structures (e.g. jacket structures) and the streamlined outer conture reduces the danger of the vehicle becoming trapped in such a structure. Of course the external cladding works also as a protection against occasional shocks during movements in the neighbourhood of ship boards, wrecks or rocks etc.

During maneuvering the whole equipment is not only alimented with energy and informations and held in a predetermined depth with one main cable but it is at the same time balanced too by the cable into horizontal inclination even when the grab is moved or the ladder is extended or a current flow stands against the vehicle etc.

The compensation of such changements of equilibrium is reached by changements of the cable length hanging free more or less and thus ending with a greater or smaller angle into the fixation bracket at the vehicles body.

For this purpose a cable length control is installed controlling the inclination of an U-shaped bracket which is fixed pivotally to the hollow body of the vehicle against the tension of bidirectional working feather elements, so that the tension of them normally holds the cable end parallel to the horizontal axis of the hollow body.

As soon as the cable is lengthened or shortened by weight or force changes the angle of its fixation moves to a respective contact which calls up to the cable winch for a compensating length correction as long as the equilibrium of the vehicle is out of stabilization.

Summarizing the submarine working equipment according to the invention constitutes a system whereby both the working possibilities under water can be greatly enlarged and the working periods shortened relative to the prior art, and whereby the safety of a diver when used, the equipment and the operating and controlling parts, can be considerably increased.

The invention will now be described, by way of example, with reference to the accompanying diagrammatic drawings, in which.

The submarine working equipment illustrated which may be a diver's auxiliary equipment includes a hollow body that is specially reinforced against bending moments and pressure forces acting upon it by means of structure defining flow channels, for driving elements, that angularly penetrate it and by means of pressure chambers supported in the body which are adapted to multiple uses. The equipment is held and supplied with power by a connecting and supply cable. A main grab on the forward end of the body is adjustable to facilitate clamping on a wide range of diameters the clamping of the equipment on pipes, wracks, etc. so firmly that the equipmenmt itself or working arms mounted thereon (tool arms, auxiliary grabs, platforms etc) are capable of taking substantial working loads despite the small dimensions of the equipment. Control instruments and the driving elements permit the equipment to be used in a particularly efficient and safe manner both as a vehicle for mobile equipment and as tool machine or energy base for auxiliary machines in submarine operations with or without a diver's presence. The equipment can be quickly and reliably adapted to changing working conditions by easy replacement of modularly interchangeable supplementary equipment.

Its movements may as well be commanded by the diver supervisor (aboard an accompanying ship carrying the cable winch and the energy source etc.) or by the diver. He uses a control desk normally integrated too into the vehicle's body (so that the diver can ride on it). For dangerous maneuvers however the diver may take the control desk out of the hollow body and may command the vehicle (and the grab or the ladder etc.)—by another, small cable in a greater distance—with the same control desk in a mobile manner.

Figure 1:
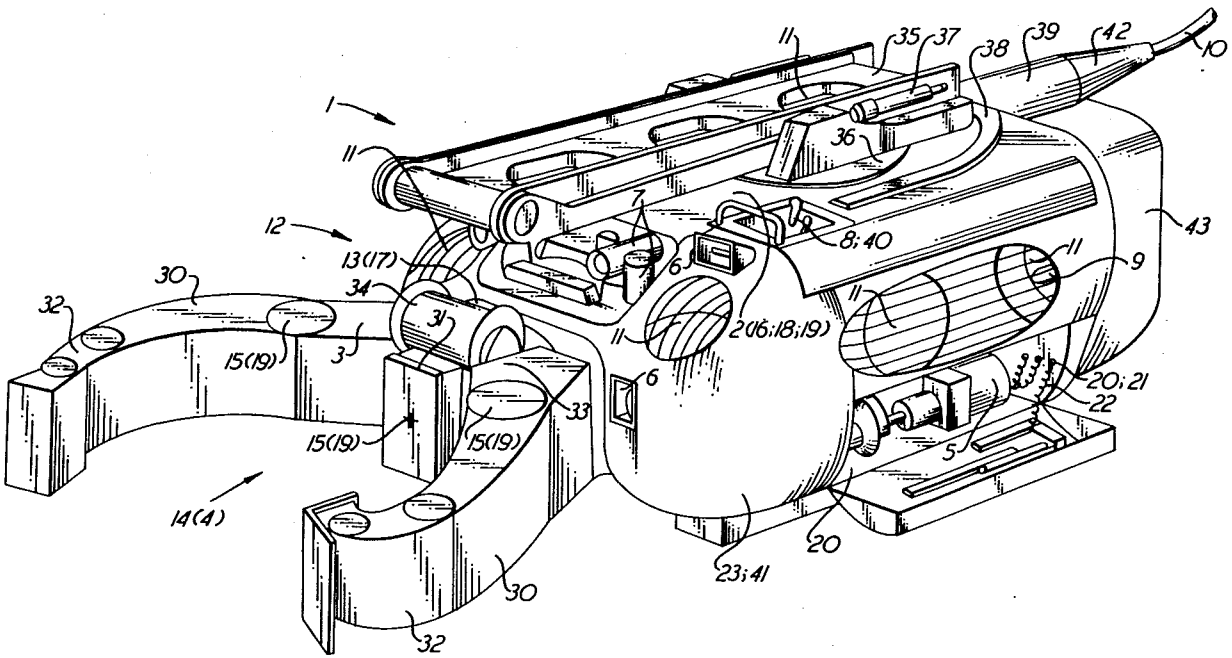
FIG. 1 is a submarine working equipment outfitted for use as a diver's accompanying auxiliary equipment.

In FIG. 1 the submarine working equipment 1 is shown in maneuvering conditions. A hollow body 2, to which are movably attached support structure and actuators for actuating gripping tool 4 or for supporting processing tools, carries, in addition, light sources 6 and orientation instruments 7 (television equipment, sonar equipment, etc.) and includes also control instruments 8 and drive elements 9. The whole equipment is both held in operation and controlled at the place of use via a trailing connection and supply cable 10 originating from a submarine base (not shown). For this operation and control drive elements 9 (for instance, motor driven propellers) are provided in different flow channels 11 that penetrate the hollow body 2 (or are situated thereon) and can be set in motion and regulated as needed by remote control originating from the control board of the submarine base or by the diver on the equipment. The flow channels are defined by structure connected to the hollow body to structurally reinforce this body.

On the forward end 12 of the hollow body 2 there is a recess 13 open at the top and bottom, in which the main grab 14 has a swivel axis 15 defined by a bearing 17 in the interior space 16 of the hollow body 2. Pressure chambers 18 house valves and switches, etc. for the drive 19 provided to actuate the gripping tool 4 and the driving elements 9. A tool box 20 arranged to be opened from the outside houses connections 21 and the equipment suspension lines 22 and can contain different processing tools 5 when used as diver auxiliary equipment.

The gripping arms 30 of the main grab 14 can be moved together with the support 31 telescopically out from the hollow body toward a body to be encircled between the gripping arms and back again. At the free ends of the gripping arms 30, swinging clutchers 32 can further improve the operation of the gripping arms 30. On a transverse member 33 connecting the gripping arms 30 and movable with support 31 thereof there is mounted a winch 34. When the main grab 14 is rotated relative to the hollow body there is an extensible and foldable ladder-like platform 35, which can be extended across the working equipment 1 at any angle desired on a rotatable pad 36 recessed in and mounted on the hollow body. The platform drive 37 consists of hydraulic cylinders and pivot drives arranged to be actuated, as needed, by a diver on the platform 35 itself or from the equipment 1. A swinging U-shaped bracket 38 is pivotally supported on either side of the normal mass center of the hollow body 2 and carries a cable inlet chamber 39 which supports the end of the trailing and supply cable 10 ends at the rear of the equipment in a manner such that different angles of cable entrance can be provided and the cable weight can be used in part as a trimming aid. In the normal case the diver will control the equipment 1 at the control desk 40 that is removeably recessed in the hollow body 2 on the top thereof. Here he can lie on the equipment or remove the control desk 40 from the hollow body and control the equipment from a safe distance by way of a long control line. In the streamlining 23 and also in the empty spaces of the hollow body 2 that are not otherwise used, lifting bodies 41 can be accommodated as may be needed. The structure defining the lifting bodies or chambers is rigidly attached to reinforce the hollow body 2. Cable 10 pull-out torques, which cannot be easily compensated by the lifting members 41, can be compensated advantageously by means of a cable-length control 42 which is preferably inserted in the cable inlet chamber 39 when, for instance, a displacement of the mass center on the gripping tool 4 or of the hollow body 2 is inevitable (for instance, by virtue of supplementary attachment 43).

The cable-length control 42 is an arrangement of switches controlling the inclination of the cable end in view of the vehicle's axis. The cable end pivotally fixed to a traverse of the bracket 38 is held parallel to this axis by bidirectional working suspension elements as long as a certain equilibrium is given. With the growing inclination caused by any changements of the equilibrium one side of the bracket 38 approaches one of the switches signalling to the cable winch for respective shortening or lengthening movements of the cable and so regaining the former standard inclination.

Figure 2:
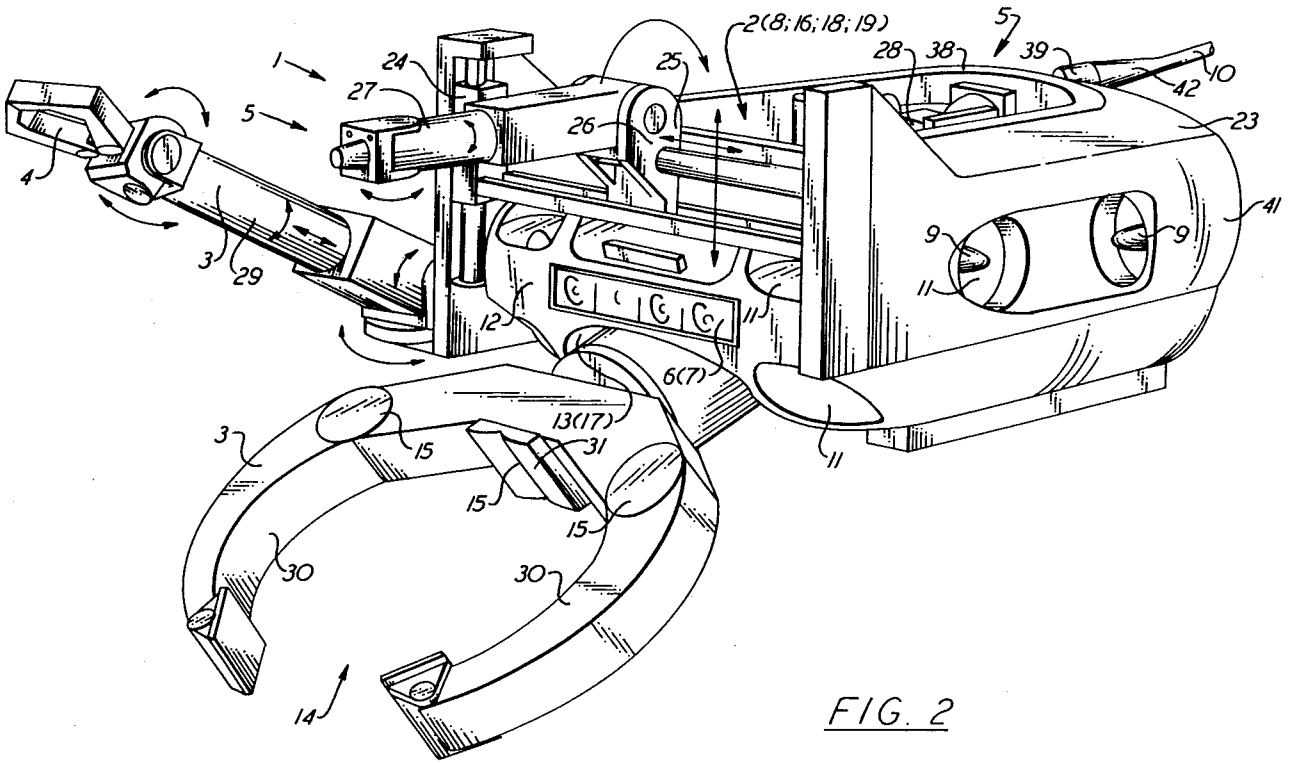
FIG. 2 is the equipment outfitted for unaccompanied use as a submarine tool machine.

In FIG. 2 the submarine working equipment is designed additionally with means providing for the entirely unaccompanied use as a tool machine. For this purpose there are secured to the hollow body 2, on both sides of the front wall 12, parallel linearly adjustable members 24 parallel with the flow channels 11 vertically disposed on both sides of the recess 13. Said vertical linearly adjustable members 24 support therebetween a horizontal adjustable member 25 for vertical adjustment closer to or farther from the rotation axis of the main grab 14. On the horizontal linearly adjustable member 25, a tool support 26 can be laterally moved transverse of the main grab 14 between the vertical linear adjusting members 24. On the tool support 26 is preferably pivotally attached a tool support bracket 27 that is changeable both as to its distance and to its sloping position in the direction of a processing point situated above the main grab 14. The tool support bracket 27 can simultaneously interact automatically with a tool-exchanging automatic machine 28 recessed behind it in the top of the hollow body in place of the rotating pad 36. In the case of complicated problems of assembly, there is the possibility of also using, independently of the processing operation, an auxiliary grab 29 secured outside the working range of the linear adjusting members but capable of reaching said range. While maneuvering, this auxiliary grab 29, folded back perfectly parallel with the streamlining of the working equipment 1, can remain arrested in a manner such as to adapt itself to the profile of the streamlining 23 without significant projections.

Figure 3:
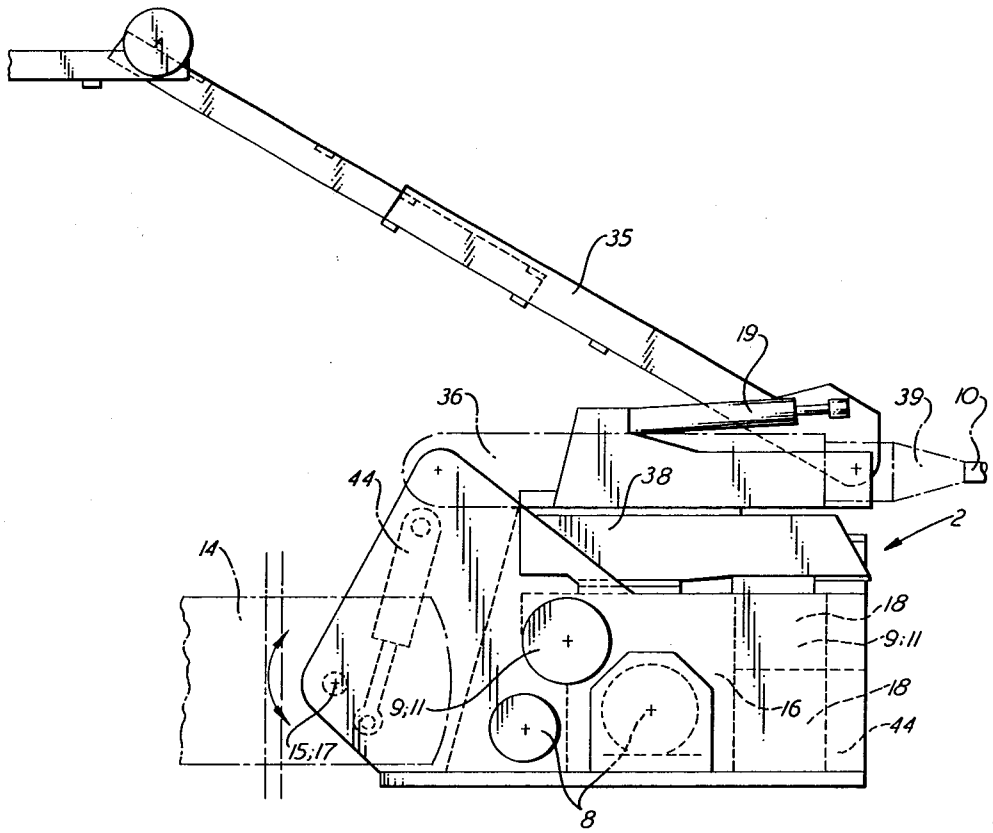
FIG. 3 is a sideview of the equipment without streamlined exterior showing the outer drive elements.

In FIG. 3 is a preferred design of the structure of the hollow body 2 diagrammatically shown in sideview. In these illustrations the main grab 14 is pivotally moveable upwardly and downwardly on its bearing 17 which is on the left side of the recess 13. The pressure chambers 18 that in the figure appear in the interior space 16 to the right of the recess 13 are covered. On the rear (to the right in the figure) remote from the grab 14, hydraulic oil tanks 44 are provided in other pressure chambers 18 at both sides of a vertical flow channel 11. The horizontal flow channel 11 above the pressure chambers 18 near the bearing 17 of the main grab 14 additionally reinforces the hollow body 2 in the area thereof on which a rotable pad 36, a tool-exchanging automatic machine 28, or similar means can be modularly supported according to the intended use of the working equipment 1. These component parts, for instance, 36 or 28, etc., are normally partially encircled by the swinging bracket 38 that supports both cable inlet 39 and, in an unfolded condition, carry means for the whole working equipment 1. The swinging bracket 39 is supported here above the recess 13 substantially on the highest point of the hollow body 2 in the sidewalls of the hollow body and is pivotable relative thereto about a horizontal axis.

The grab 14 can be inclined up and down relative to the vehicle's axis by hydraulic cylinders 44 arranged well protected between the side walls of the recess 13. Independently the grab 14 can be turned also around its longitudinal axis preferably over a great ring gear 45 on its base drum 46 central to the axis. The ring gear 45 is driveable by a gear motor 47 from outside the grab's base drum 46.

Figure 4:
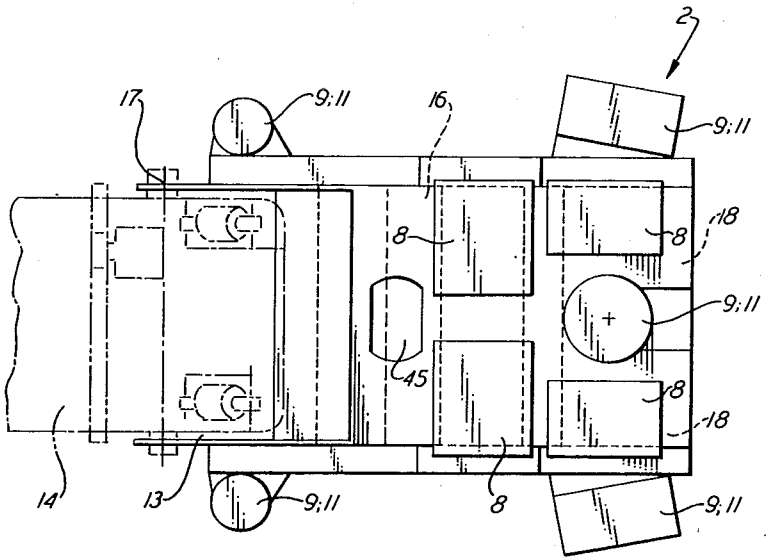
FIG. 4 is a top view of the equipment shown in FIG. 3.
Figure 5:
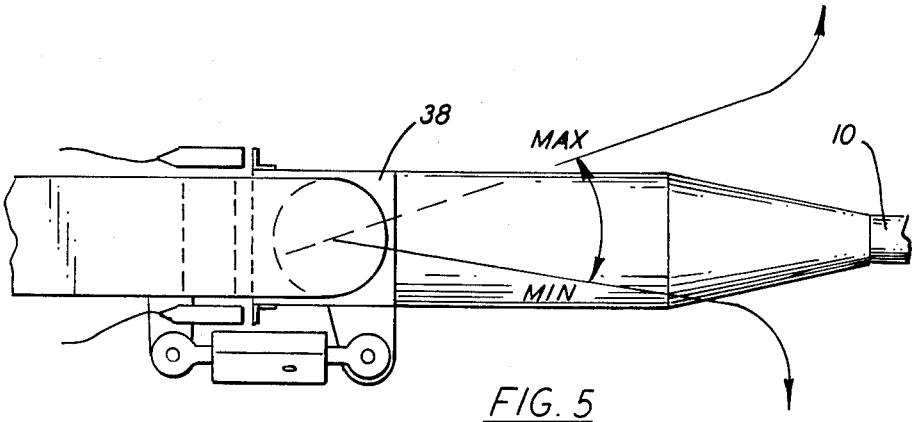
FIG. 5 is a side view of the cable length control.
Figure 6:
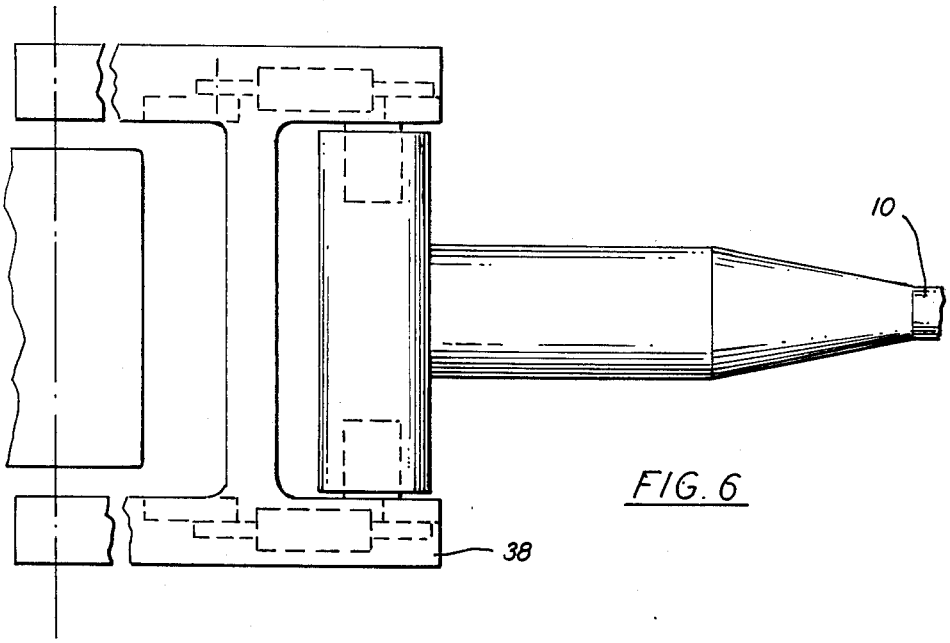
FIG. 6 is a top view of the bracket in which the cable end is pivotally fixed in a transverse always held in almost horizontal position with the help of the feather elements cooperating with the cable length control shown in FIG. 5.
Figure 7:
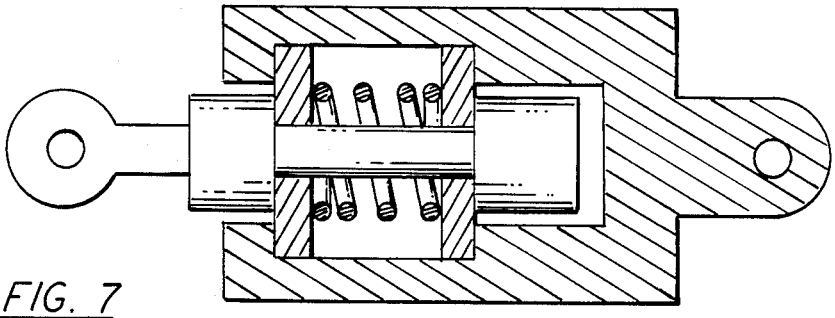
FIG. 7 shows a cross section through the feather element mounted between the bracket and the cable end.

In FIG. 4 is illustrated in topview the structure of the hollow body 2. Behind the recess 13 can be seen an opening for the driving element 9 disposed in the horizontal flow channel 11. To the right thereof, substantially in the center of the hollow body 2, there can be seen two square lids of pressure chambers 18 for hydraulic valves for the control of the drives 9 and 19. On the stern can be seen, in the middle of the vertical flow channel 11 and on both sides thereof, additional pressure chambers for slide boxes (above the hydraulic tank 44).

Not shown in FIGS. 3 and 4 is the streamlining 23 to be situated outside on the hollow body 2 or the lifting members combined therewith and the tool boxes 20 etc. located therein.

This assembly is extremely compact and yet offers easy access to the component parts, it possible in particular that the suspension point with the swinging bracket 39 are substantially above the location of the mass center when the grab is horizontal and the platform 35 is folded. The resultant of all active lines from the different driving elements comes in this operating position to lie close to or in the mass center so that a minimum expenditure of energy is necessary for the correction of position as long as no torque effect of grabs or arms occur.

The streamline cladding of the hollow body 2 and its outer buoying elements facilitates the use of the equipment in narrow spaces (e.g. jacket structures, wracks etc.) and serves as shock protection hull. The streamlining 23 has apertures where necessary and is adapted to integrate as much of the propeller drives and manipulation equipment (grab, ladder etc.) as possible.

Figure 8:
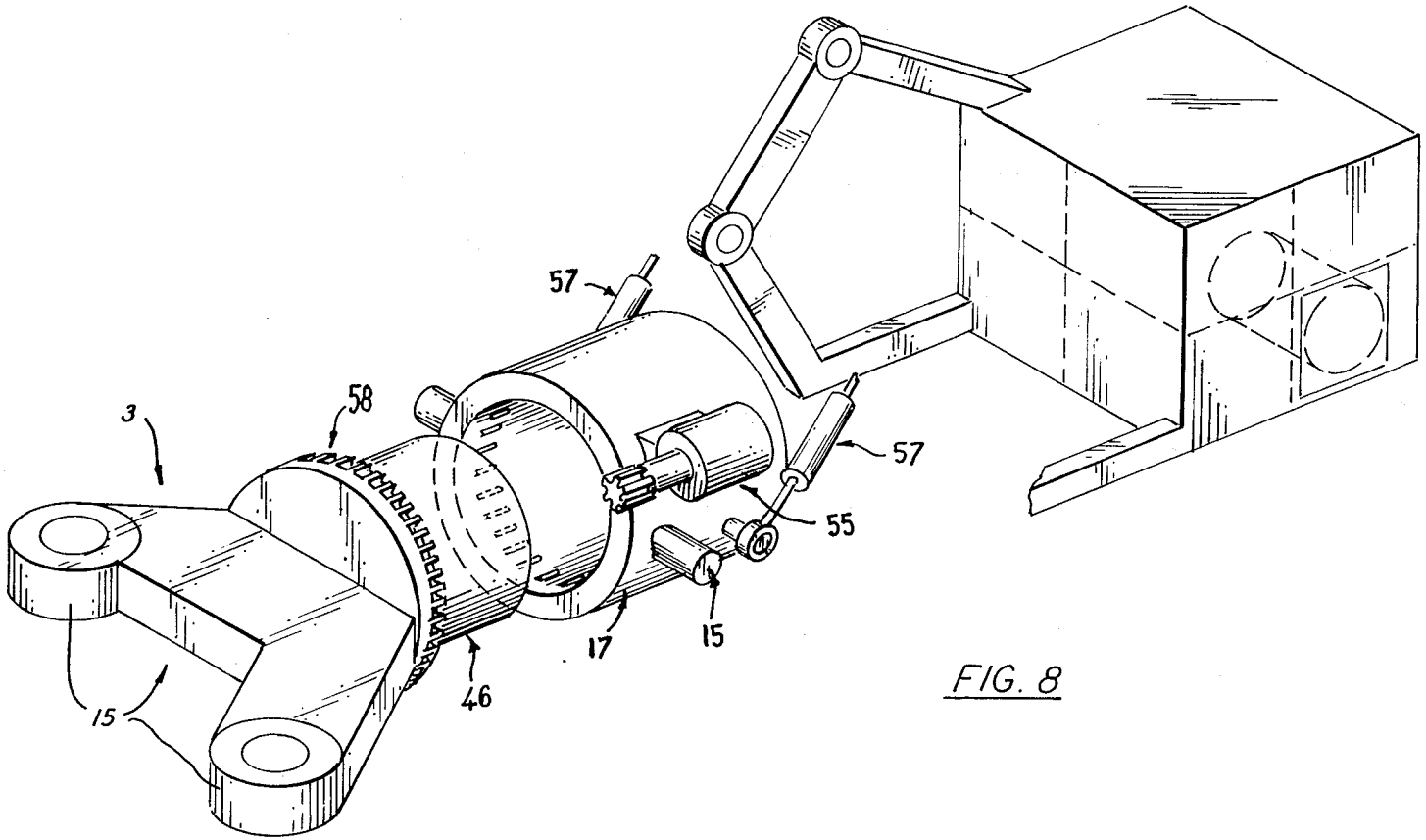
FIG. 8 shows a schematic assembling arrangement of the fixation and drive of the main grab at the front side of the vehicle's body.

In FIG. 8 the grab 3 is prepared to be assembled with a barrellike bearing 17 which is pivotally mountable in the side walls of a recess 13 in the front side of the hollow body 2. The recess 13 is open at its top and at its bottom and is crossed by the grab's swivel axis 15 from side wall to side wall so that the bearing 17 itself may be swivelled in an angle of about 180° up and down. Such movements are executed by the grab pivoting cylinders 57 mounted inside the side walls of the recess 13. The cylinders 57 are fixed with one eye to the hull of the bearing barrel 17 eccentric to the axis 15 at the side wall near the angle-point of the swinging bracket 38. The grab 3 itself is held in the bearing barrel 17 with a cylindric drum surrounded by a ring gear 58 driveable by a grab turning gear drive motor 59 which is positioned also upon the hull of the bearing barrel 17 so that it meshes with the ring gear 58.

The energy for cylinders and motors is supplied and distributed by tubes and cables mostly inside the hollow body and the grab structure from the power station in the tighted chambers of the hollow body.

In the example described here there is provided an oil-submerged electromotor (fed by the main cable 10) driving several hydraulic pumps directly.

Figure 9:
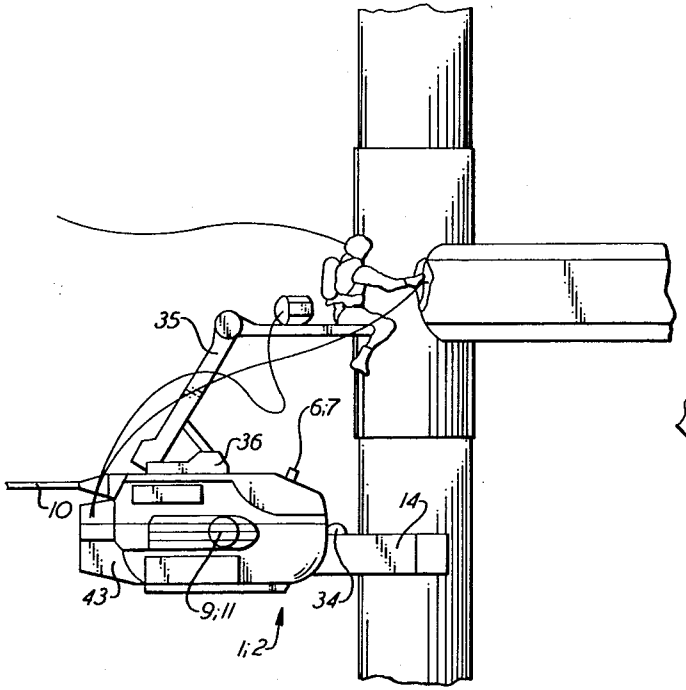
FIG. 9 is the submarine working equipment when used as mobile structure with attached supplementary instruments (for instance, instruments for testing materials)

In FIG. 9 the submarine working equipment 1 with the main grab 14 supported in the hollow body 2 thereof is bedded on a barrel support and is supplied with energy and monitored via the trailing and supply cable 10 that here needs not assume any trimming functions. In the example the supplementary equipment attachment 43 (for instance, for welding work) is mounted on the equipment and the driver has extended the platform 35 to support himself while busy with processing tools 5 via the platform 35 and the rotating pad 36 upon the hollow body 2 held fast by the main grab 14. The course of the work can be observed from the submarine station by means of the light sources 6 and of the orientation instruments 7 (sonar, television cameras) that are mounted in the working equipment 1.

Figure 10:
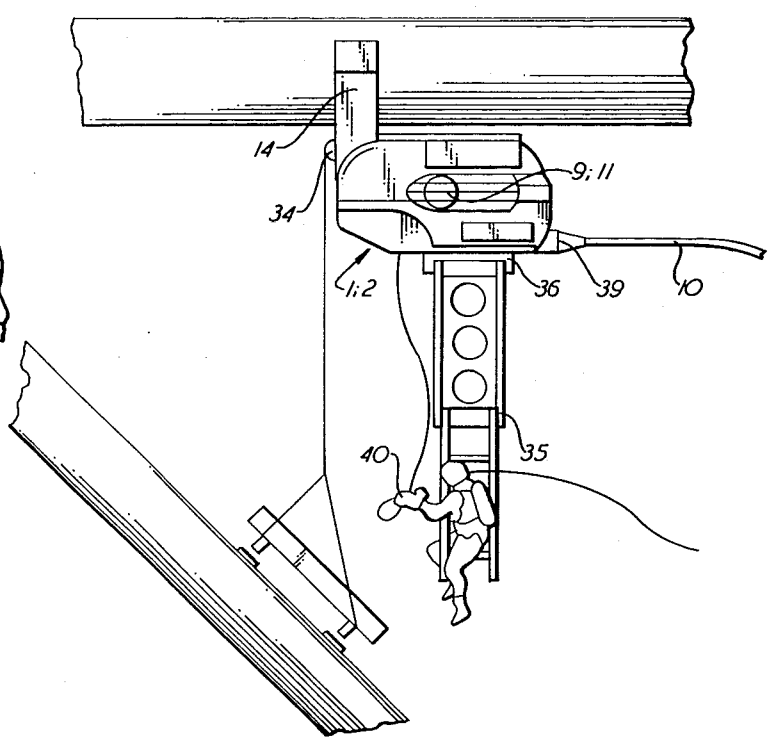
FIG. 10 is the same equipment but used as hoisting apparatus or load transporter.

In FIG. 10 the submarine working equipment 1 is clamped with the main grab 14 on a horizontal duct in the reverse position compared to the arrangement of FIG. 3, the winch 34 being used for retaining or transporting structural parts. The diver has proceeded from the working equipment 1 via the vertically downwardly extended hinged platform 35, which is provided with apertures and ladder rungs, to a stationary point in the proximity of the mounting site, but apart from the working equipment 1. The diver can here control the winch and eventually the platform via the control desk 40 removed from the hollow body 2, which desk communicates with the control instruments 8 and the accessory drives 19 in the hollow body via an adequate trunk line.

In the case of such and many other uses, the smooth outer contour of the working equipment and the configuration adapted to multiple uses and very compact of the hollow body 2 are advantageous not only for preventing accidents and damages but also because of the high basic rigidity of the hollow body and the high loading capacity resulting therefrom by the different torques acting upon it according to the position of the grabs and of the platform or the kind and magnitude of the reaction forces from the different uses of processing tools.

We claim:

1. In a submarine working equipment comprising an equipment carrier to which are mounted operating implements, light sources, orientation instruments and control instruments, and driving elements and a main grab for securing said equipment to an object to be worked on, said working equipment being held captive and supplied with power by a connecting and supply cable wherein said equipment carrier is a self-supporting hollow body, penetrated by flow channels angularly disposed in relation to each other, in which said driving elements are situated, the improvement wherein on one end of said hollow body there is provided a grab bearing assembly for said main grab which is supported substantially adjacent the mass center of the equipment, said grab bearing assembly permitting movement of said main grab about longitudinal and transverse axes, said main grab comprising two arms inwardly pivotable in opposite directions cooperating with an abutment in the longitudinal axis, and a support movable about said longitudinal and transverse axes, said main grab being powered by way of said supply cable, said body being reinforced by said grab bearing assembly and said grab bearing assembly being protected by said body from outside interference by its location in said recess.

2. A submarine working equipment according to claim 1, wherein said driving elements are provided in said hollow body on both sides of said recess to provide driving forces which are perpendicular oriented to said axes.

3. A submarine working equipment according to claim 1, wherein on said one end of said hollow body at each side of said grab there is secured first and second linearly adjustable members that are vertically disposed in the normal orientation or said equipment, said members carrying a displaceable and indexable third linearly adjustable member that in said normal orientation is horizontal, said third linear adjustment member being adapted to support and guide a tool support.

4. A submarine working equipment according to claim 3, wherein that said support has a tool bracket pivotable about said third linearly adjustable member and of changeable length, which drives or carries said processing implements.

5. A submarine working equipment according to claim 4, wherein said adjustable members, said support and said tool bracket are adapted for remote control and interact with an automatic tool exchange machine connected with said hollow body and adapted for remote control.

6. A submarine working equipment according to claim 4, wherein on said hollow body of said working equipment and outside the working range of said main grab there is situated an auxiliary grab which has an access range for interaction with said tool bracket.

7. A submarine working equipment according to claim 2, wherein said main grab can be moved at least 90° about said transverse axis.

8. A submarine working equipment according to claim 7, wherein a winch is mounted for rotation with said grab about said transverse axis.

9. A submarine working equipment according to claim 1 wherein said abutment is moveable longitudinally along said longitudinal axis.

* * * * *